US006450749B1

(12) United States Patent
Ganter

(10) Patent No.: US 6,450,749 B1
(45) **Date of Patent: *Sep. 17, 2002**

(54) ARRANGEMENT FOR APPLYING AN ADHESIVE ONTO OUTER SURFACES OF AN INNER BOOK TO BE INSET INTO A BOOK COVER BY MEANS OF AN INSET MACHINE

(75) Inventor: Christian Ganter, Bieberehren (DE)

(73) Assignee: GRAPHA-Holding AG, Hergiswil (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/604,029

(22) Filed: Jun. 27, 2000

(30) Foreign Application Priority Data

Jul. 22, 1999 (EP) ..... 99810660

(51) Int. Cl.[7] ..... B42C 13/00

(52) U.S. Cl. ..... 412/37; 412/4; 412/8; 412/19; 412/25; 412/29; 412/30

(58) Field of Search ..... 412/4, 8, 19, 25, 412/29, 30, 37

(56) References Cited

U.S. PATENT DOCUMENTS

| | | | | |
|---|---|---|---|---|
| 4,662,979 A | * | 5/1987 | Kupka et al. | 412/37 |
| 4,732,521 A | * | 3/1988 | Kolkhorst | 412/37 |
| 5,868,539 A | * | 2/1999 | Rathert | 412/37 |
| 6,186,721 B1 | * | 2/2001 | Ganter | 412/4 |

FOREIGN PATENT DOCUMENTS

| | | | |
|---|---|---|---|
| DE | 2556337 | * | 6/1977 |
| DE | 37 13 896 A1 | | 10/1987 |
| DE | 37 13 896 C2 | | 7/1994 |

* cited by examiner

*Primary Examiner*—A. L. Wellington
*Assistant Examiner*—Mark T. Henderson
(74) *Attorney, Agent, or Firm*—Friedrich Kueffner

(57) ABSTRACT

An arrangement for applying an adhesive to outer surfaces of an inner book to be inset into a book cover by an insetting machine, moving inner books on saddle plates of a circulating conveyor vertically upwardly. The arrangement has an adhesive applying device with two application rollers positioned opposite one another in an area of adhesive application. The two application rollers each roll along one of the outer surfaces of the inner book to apply an adhesive onto the outer surfaces of the inner book as the inner book is moved upwardly on a saddle plate. The two application rollers each have a recess forming a shoulder parallel to an axis of rotation of the application rollers, wherein the recesses apply the adhesive to grooves of the inner book and wherein a rotary position of the recesses is adjustable according to a position of a given groove shape of the inner book passing through the area of adhesive application. The two application rollers and the conveyor of the saddle plates are coupled by a drive connection so as to be driven in a cycle-synchronized way. The drive connection has a pulling element gear unit for a continuous adjustment of a relative position between the saddle plates and the rotary position of the application rollers.

16 Claims, 5 Drawing Sheets

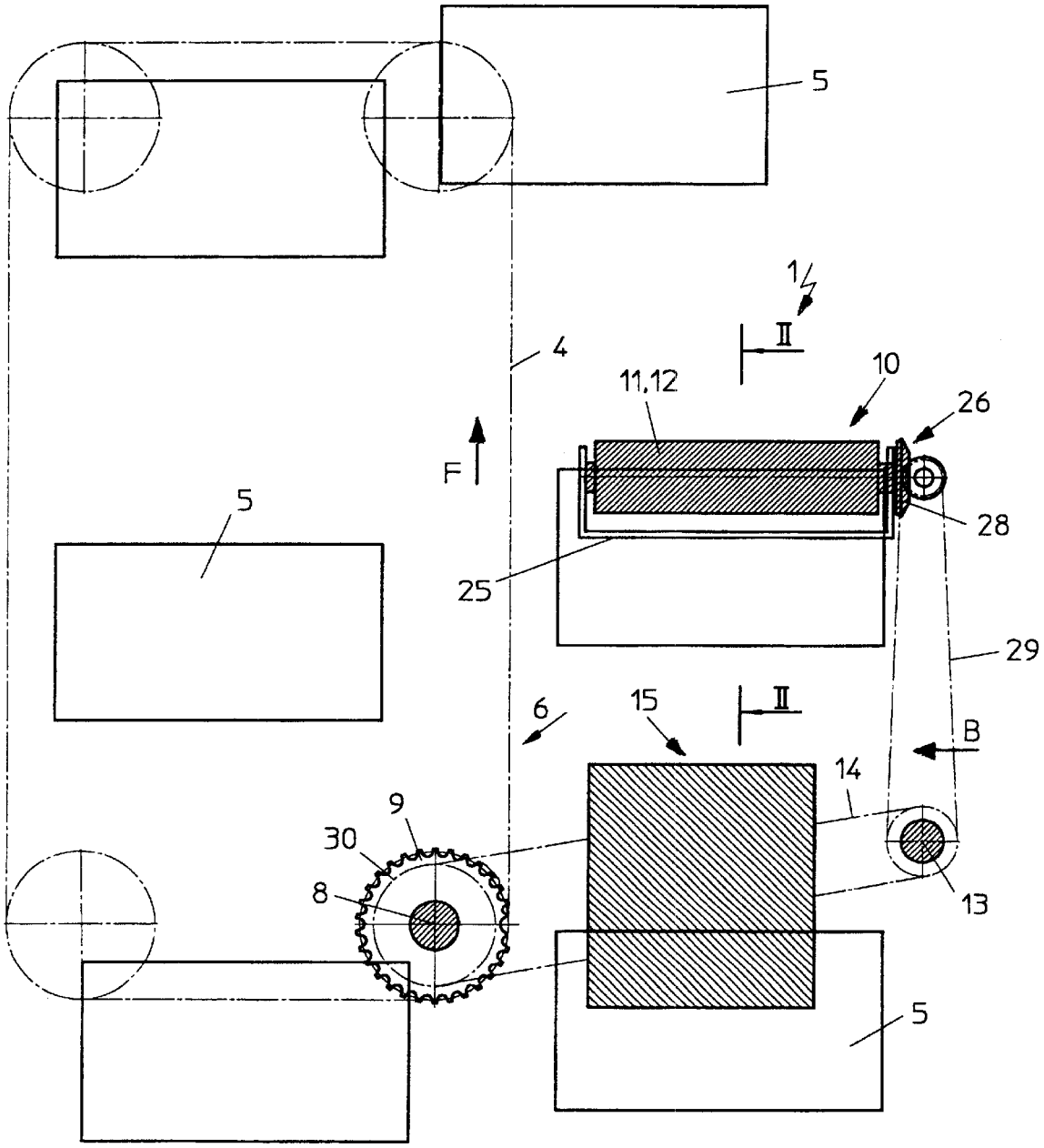
FIGUR 1

FIGUR 2
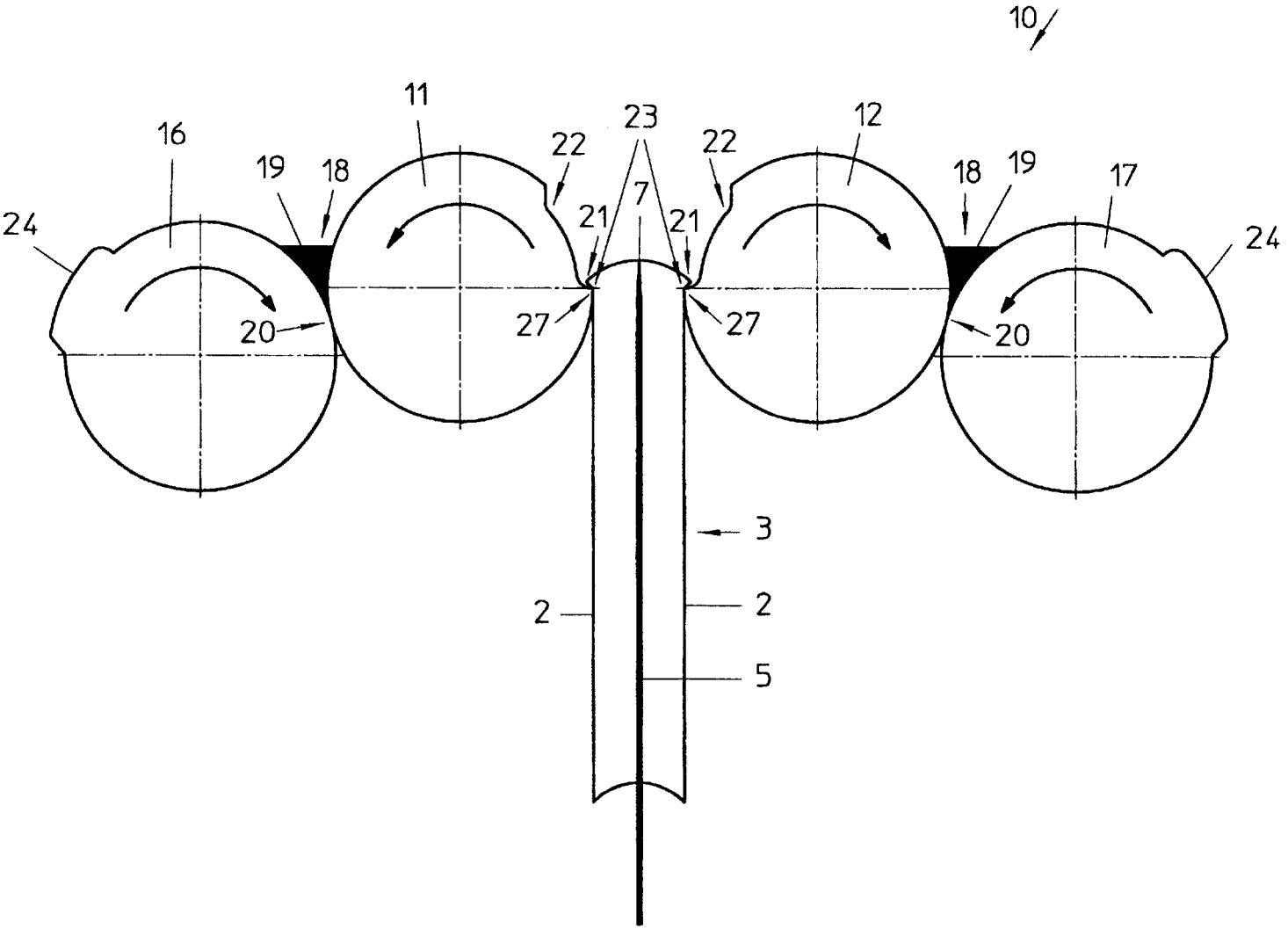

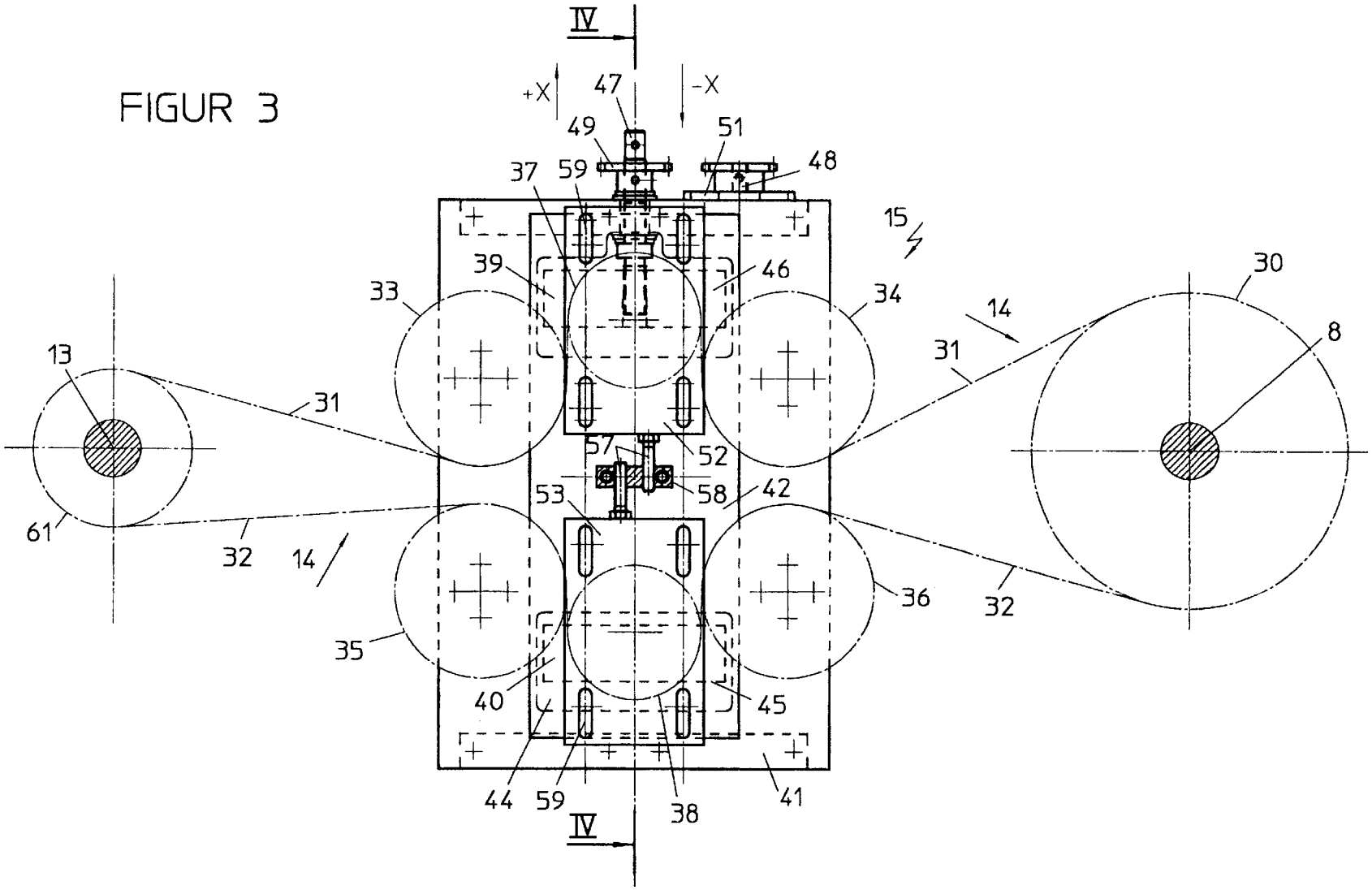
FIGUR 3

FIGUR 4
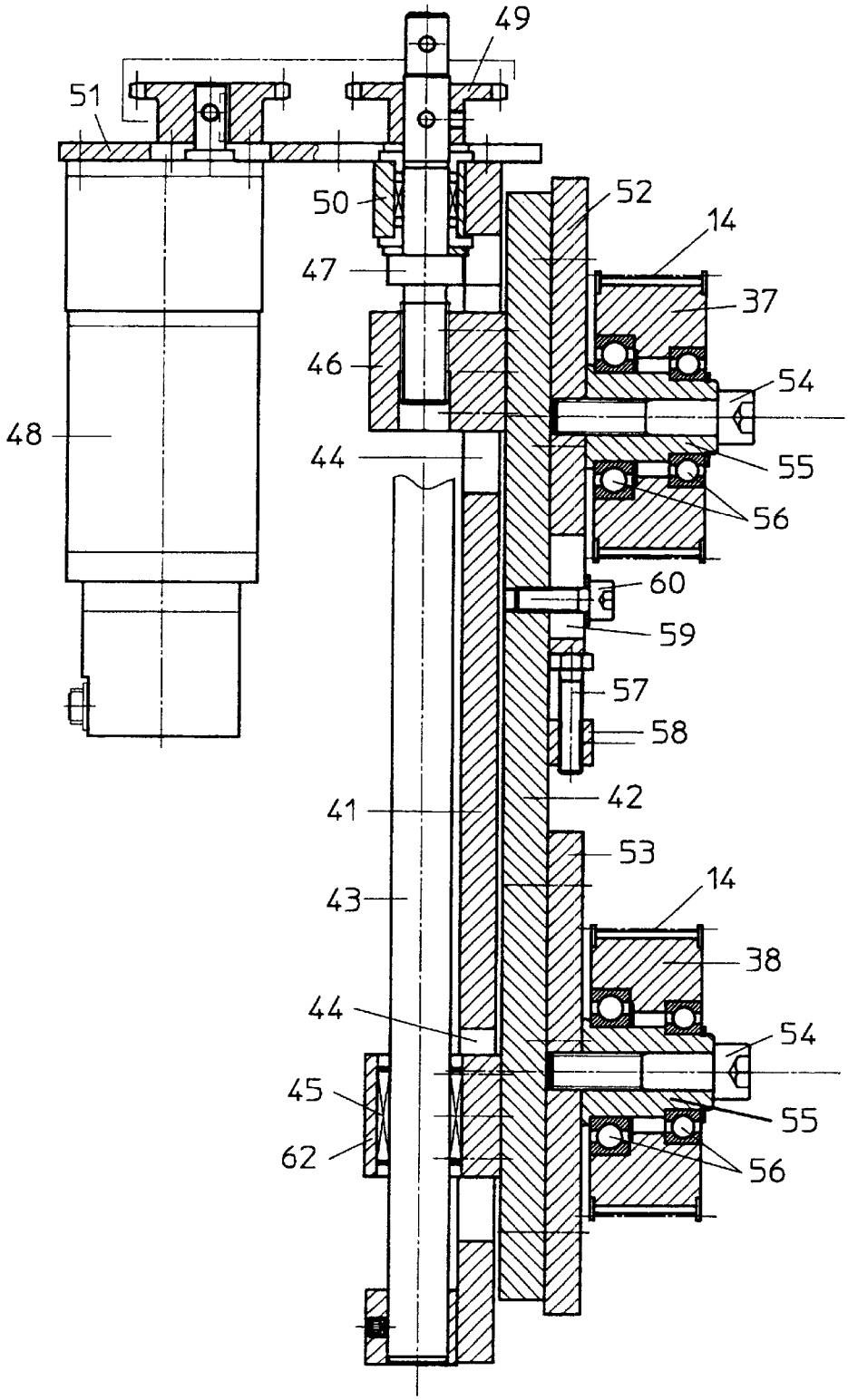

FIGUR 5
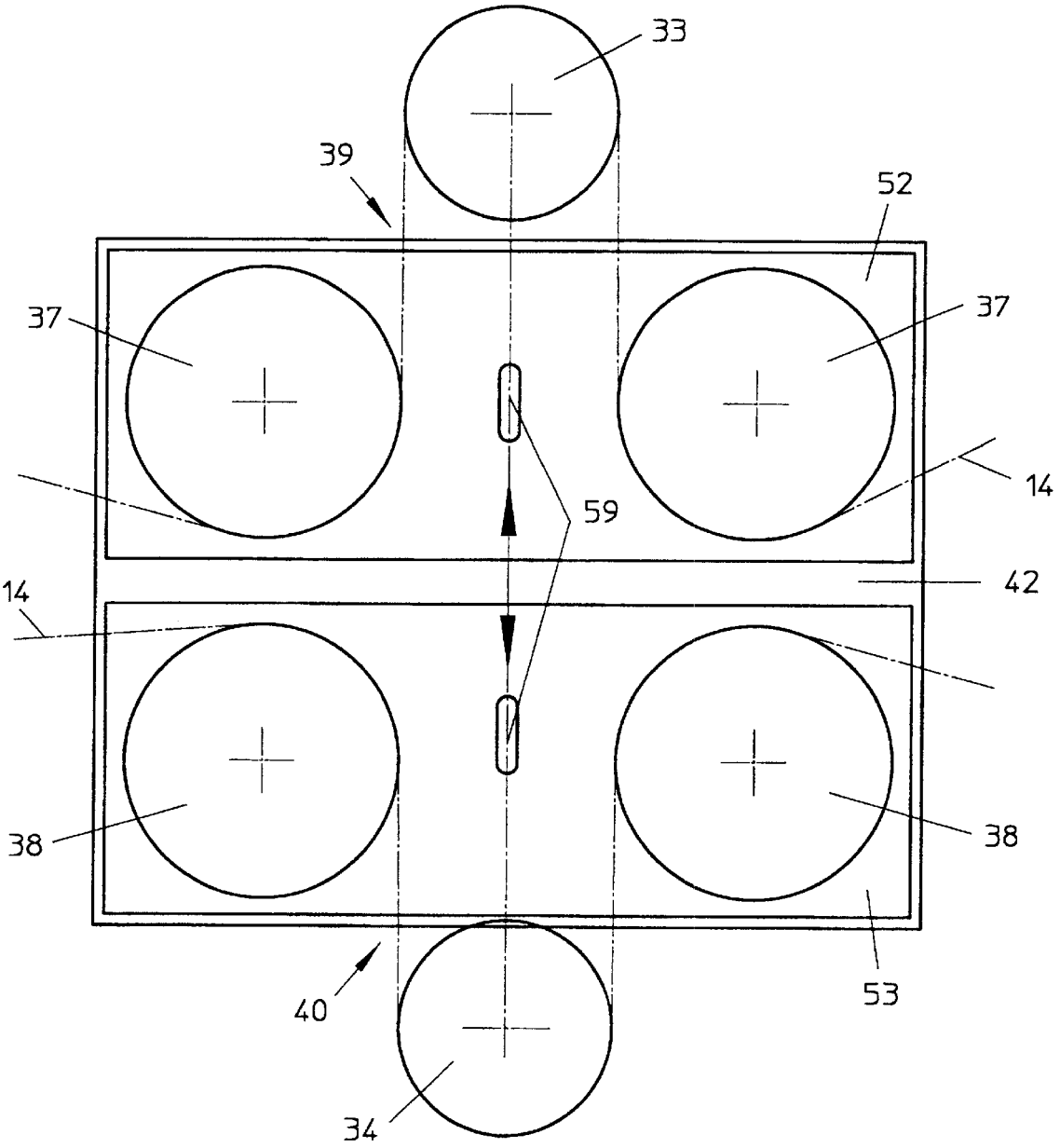

ARRANGEMENT FOR APPLYING AN ADHESIVE ONTO OUTER SURFACES OF AN INNER BOOK TO BE INSET INTO A BOOK COVER BY MEANS OF AN INSET MACHINE

BACKGROUND OF THE INVENTION

1. Field of the Invention

The invention relates to an arrangement for applying an adhesive to the outer surfaces of an inner book to be inset into a book cover by an insetting machine, comprised of two application rollers of an adhesive application device, the application rollers positioned opposite one another within the area of adhesive application and rolling respectively along an outer surface of an inner book transported on a vertically upwardly moving saddle plate of a circulating conveyor, wherein the application rollers have a recess forming a shoulder parallel to the axis of rotation for applying the adhesive in the area of adhesive application in the groove area of the inner book, wherein the rotary position of the recess can be adjusted and changed according to the position of a certain grove shape of an inner book passing through the area of adhesive application, wherein the conveyor of the saddle plates and the rotary movement of the application rollers are connected drivingly in a cycle-synchronized manner.

2. Description of the Related Art

The adjustment of the application rollers relative to the inner book in an insetting machine up to now has required considerable time and is only possible when the insetting machine is stopped. In this context, the drive of the adhesive application rollers must be detached from the main drive in order to be able to align the shoulder of the adhesive application roller formed by the recess to the groove area or groove angle of an inner book moved on a saddle plate into the respective position.

According to German patent document DE-B-37 13 896 this disadvantage is to be eliminated in that above the adhesive application rollers a positioning indicator is arranged with which the so-called groove angle of an inner book is to be aligned at the same level, wherein this alignment position of the inner book forms the reference zero position of the conveyor to which the front edge of the recess or the shoulder of an adhesive application roller is to be adjusted. In this way, the drive of the adhesive application rollers is to be aligned by means of a positioning point analog to the shoulder of the rollers with the reference zero point of the conveyor. This may result in a better alignment and may shorten the set-up time, but the aforementioned disadvantages are not yet eliminated.

SUMMARY OF THE INVENTION

It is an object of the present invention to provide apparatus-related measures for a device of the aforementioned kind with which the alignment of the adhesive application rollers to the inner book can be significantly improved qualitatively as well as quantitatively.

In accordance with the present invention, this is achieved in that the drive connection between the conveyor and the application rollers comprises a pulling element gear unit for a continuous adjustment of the relative position between the saddle plates and the rotary position of the application rollers.

This makes it possible to perform the adjusting process between the transported inner book and the adhesive application rollers within a short period of time in an exact and very simple manner, even when the machine is running.

Decoupling from the main drive shaft is no longer required.

In an advantageous further embodiment of the inventive arrangement, the pulling element gear unit is drivingly connected by a circulating pulling element, for example, a chain or toothed belt, with the conveyor, on the one hand, and with the application rollers, on the other hand, which is a simple assembly measure that can also be realized for already existing machine concepts.

In a preferred embodiment, the circulating pulling element guided about the drive shafts of the conveyor and of the application rollers has two portions and each portion is guided about a stationarily supported roller pair of two laterally spaced apart deflection rollers and a control roller positioned between the deflection rollers and freely rotatably supported on a slide that is moveable on a guide arrangement, wherein each portion forms an open loop extending between the deflection rollers and guided about the control roller.

As an alternative, the pulling element guided about the drive shafts of the conveyor and of the application rollers can form two portions which are guided respectively about two spaced apart control rollers of a roller pair, mounted freely rotatably on a slide which is adjustable on a guide arrangement, and a stationarily supported deflection roller thus forming an open loop extending between the control rollers and guided about the deflection roller.

Both configurations of guiding the pulling element do not differ with regard to their effect, but the latter arrangement requires a slide with larger dimensions.

Moreover, it would be possible to supplement the roller pairs as in the situation of a pulley block by additional rollers so that the adjusting process of the slide could be realized with a further reducing action.

Advantageously, the slide is adjustable in the guide arrangement perpendicularly to a plane which extends through the rotational axes of a roller pair so that symmetrical conditions are present.

Expediently, for simplifying the attachment, the guide arrangement for receiving the slide is connected with the frame of the insetting machine.

The slide can be manually driven or driven by a controllable motor wherein the drive is realized mechanically or by a linear drive.

It is favorable when the slide is provided at the side facing away from the deflection rollers or the rollers, with threaded bushings into which a spindle is screwed so that a compact and easily accessible construction is realized.

For a preadjustment of the slide and for tensioning the pulling element, it is advantageous when the control rollers or the roller pairs are supported each on at least one tensioning plate that can be displaced on the slide in the movement direction of the slide.

BRIEF DESCRIPTION OF THE DRAWING

In the drawing:

FIG. 1 shows a schematically represented insetting machine for inner books;

FIG. 2 is a detail view of a schematically represented adhesive application device in section according to section line II—II of FIG. 1;

FIG. 3 is an end view of the pulling element gear unit of the device;

FIG. 4 is a section of the pulling element gear unit according to the section line IV—IV of FIG. 3; and FIG. 5 is a schematic representation of an alternative pulling element gear unit.

DESCRIPTION OF THE PREFERRED EMBODIMENTS

The FIGS. 1 and 2 represent an arrangement 1 according to the present invention of an insetting machine for applying an adhesive onto the outer surfaces 2 of an inner book 3. Arrow F indicates in FIG. 1 the movement direction of multiple saddle plates 5 connected to a circulating conveying member 4 which together form a paternoster-like conveyor 6. FIG. 1 shows furthermore the constant position of the saddle plates 5 along the movement path having an at least approximately horizontal upper edge 7.

The drive of the conveyor 6 is realized by means of a chain wheel 9 mounted on a drive shaft 8. The inner books 3 are brought with their open front side pointing in a downward direction, according to arrow B in FIG. 1, by means of an inner book divider, which spreads the inner book centrally, into a receiving position of the conveyor 6 in which the saddle plates 5 receive the slightly spread apart inner books 3 by penetrating them from below. Subsequently, the inner books 3 straddling the saddle plates 5 pass in the vertical direction upwardly through an adhesive application device 10, and, subsequently, a book cover supplied from the side is pressed onto the adhesive-coated outer surfaces 2 or end papers of the inner books 3. According to FIG. 1, the drive of the two application rollers 11, 12 forming the adhesive application device 10 is realized by an intermediate shaft 13 coupled to the drive shaft 8 of the conveyor 6 by means of a pulling element 14 of a pulling element gear unit 15 represented as a black box and to be discussed in the following.

The adhesive application device 10, shown in FIG. 2 and selected as an example of such devices, is comprised essentially of the application rollers 11, 12 and dosage rollers 16, 17 respectively correlated therewith which are partially immersed into the liquid adhesive contained in an adhesive reservoir 25, wherein the dosage rollers 16, 17 are profiled at their circumference. The direction of rotation of the application rollers 11, 12 and of the dosage rollers 16, 17 is indicated by arrows. Also indicated is the movement direction of the inner books 3 straddling the saddle plates 5. The application rollers 11, 12 as well as the dosage rollers 16, 17 have over the greater portion of their circumference a circular cylindrical circumferential surface. The axes of the different rollers are staggered to one another and form in the area of the greatest approximation a wedge 18 for a metered amount of adhesive 19. The two rollers 11, 16 and 12, 17 pass through a rolling zone (nip) 20 from the top to the bottom where the dosage rollers 16, 17 supply the surfaces of the application rollers 11, 12 with a certain amount of adhesive (i.e., a certain layer thickness). The amount of adhesive can be determined by the spacing of the rollers 11, 16 and 12, 17. The application rollers 11, 12 apply the entrained adhesive onto the outer surfaces 2 of an inner book 3 which comes into contact with the application rollers 11, 12 at a location approximately opposite the roller zone (nip) 20 while being moved in an upward direction. In order to supply, especially in the groove area 21 of the inner book 3, the desired amount of adhesive, the application roller 11, 12 is provided with a recess 22 which is of such a depth that a shoulder formed at the rearward end, when viewed in the rotary direction, can receive the groove 23 of the inner block 3. Accordingly, at the dosage roller 16, 17 a complementary projection 24 is formed that matches the recess 22 and, upon rotation of the rollers 11, 16 and 12, 17, penetrates into the recess 22 when passing through the rolling zone 20. The projection 24 ensures that, when passing through the rolling zone 20, the amount of adhesive 19 in the roller wedge 18 is retained and the surface of the recess 22 obtains the required amount of adhesive for applying the proper amount of adhesive to groove 23. The recess 22 and the projection 24 extend respectively parallel to the axes of the rollers 11, 16 and 12, 17 and perpendicularly to the plane of the drawing and have identical profiles. This configuration of the application (11, 12) and dosage rollers (16, 17) is within the realm of the prior art and is provided as an exemplary explanation of the function of an adhesive application device 10, as illustrated in FIG. 1 in a simplified manner mounted within an adhesive reservoir 25. Because of the special arrangement of the conveyor 6 and the adhesive application device 10 within an insetting machine, the drive connection between the conveyor 6 and the adhesive application device 10 has a drive gear reducer unit 26 with an intermediate shaft 13. The aforementioned adjustable pulling element gear unit 15 is positioned between the intermediate shaft 13 and the drive shaft 8. The drive connection between the drive shaft 8 of the conveyor 6 and a drive wheel 28 of the rollers 11, 12, 16, 17 is realized by pulling elements 14 and 29, for example, in the form of chains or toothed belts, wherein the pulling element 14 is provided for driving the adjustable pulling element gear unit 15.

The round back or spine of the inner book 3 affects the shape of the groove and also the retention of the back shape also during use of the book. The round shape of the back of an inner book can be selected according to its thickness and results in a certain groove on both sides during the so-called pressing which is subsequently to be provided with adhesive by the application roller pair. Accordingly, it is of special importance that the application rollers can be adjusted in an optimal way to the different groove shapes of the inner book 3 to be inset. The rounding and pressing inter alia are disclosed in more detail in the book "Industrielle Buchbinderei", Liebau/Heinze, Verlag Beruf+Schule, Itzehoe, or other technical literature in the book binding field.

The FIGS. 3 and 4 show a possible embodiment of the pulling element gear unit 15 interposed in the drive connection between the conveyor 3 and the adhesive application device 10 (see also FIG. 1). A toothed wheel 30 is seated on the drive shaft 8 of the conveyor 6 and is partially embraced at the driving side by the pulling element 14 and is also drivingly connected to a toothed wheel 61 fastened on the intermediate shaft 13. The shafts 8 and 13 divide the pulling element 14 into two portions 31, 32, having correlated therewith respectively a stationary roller pair of laterally spaced apart deflection rollers 33, 34 and 35, 36 as well as an adjustable control roller 42, 43 arranged therebetween. Between the deflection rollers 33 through 36 and the control rollers 37, 38 the portions 31, 32 of the pulling element 14 have oppositely positioned loops 39, 40, whose length can be adjusted by the adjustable control rollers 37, 38.

The length change of the portions 31, 32 of the pulling element 14 can effect between the cycle-synchronized shaft 8 and the intermediate shaft 13 a continuous phase displacement which provides an optimal adjusting and changing of the shoulder 27 relative to the groove 23 during operation of the machine. As explained with the aid of the directional arrows A, B in FIG. 3, upon actuation of the slide 42 by means of the threaded spindle 47 in the direction X+ an elongation of the pulling member portion 31 and a shortening of the pulling element portion 32 occur, and this causes a negative phase displacement between the rotational angles of the intermediate shaft 13 and the drive shaft 8. An actuation of the slide 42 in the counter direction X− provides a positive phase displacement between the drive shaft 8 and the intermediate shaft 13.

The phase displacement could also be realized with an electric shaft on the drive shaft and/or the intermediate shaft. However, this appears to be uneconomical at the present time.

Of course, in the inventive arrangement the pulling element portions 31, 32 could also be guided about the outer circumferential portion of the deflecting rollers 33 through 36, so that the loops fromed by the control rolls 37, 38 have open ends facing away from one another. This results in the controll rollers 37, 38 being positioned close to one another while the roller pairs are postioned farther apart. All rollers 33 through 38 are freely rotable, and the deflecting rollers 33 through 38 are supported on a plate 41, which is fixedly connected to the frame (not shown) of the inner book insetting machine, and the control rollers 37, 38 are supported on a slide 42 movable in a plane perpendicular to the axes of the deflection roller pairs 33, 34 and 35, 36. At the side of the plate 41 facing away from the rollers 33 through 38, parallel guide rods 43 are fastened, which extended on either side of the longitudinal center axis of the slide 42 and on which the slide 42 is moved. For this purpose, the slide 42 is provided with supports 62 having bearing bushings 45 each penetrating the plate 41 in a respective cutout 44, thus forming a follower 46, through which a threaded spindle 47 extends which has at its other end a chain wheel 49 connected to a gear motor 48. The threaded spindle 47 is supported on a support 50 fastened to the plate 41, and the gear motor 48 is fastened to a holder 51 connected to the plate 41. For adjusting or tensioning the pulling element 14 in the form of a toothed belt, the control rollers 36, 37 are supported respectively on tensioning plates 52, 53 which can be moved in the movement direction of the slide 42 and can be locked. For this purpose, the control rollers 37, 38 are fastened on a bearing pin 55 fastened by a screw 54 to the tensioning plate 52, 53. Deep groove ball bearings 56 are seated on the bearing pins 55 for supporting the toothed wheels 37, 38. The tensioning of the toothed belt 35 is realized by a respective tensioning screw 57 which is positioned with its head at the inner end face of the tensioning plates 52, 53 viewed in the movement direction and is adjustably screwed into a bar 58 that is mounted on the slide 46 and positioned between the tensioning plates 52, 53. The tensioning plates 58, 59 each have four guide slots 59 which are each penetrated by a fastening screw 60 fastened to the slide 42 and provided with a washer under the screw head.

The pulling element gear unit 15 according to FIG. 5 differs from that of FIGS. 3 and 4 in that, on the one hand, instead of one control roller 37, 38 for each portion, two control rollers 37, 37' and 38, 38' are correlated with each pulling element portion and fastened on the adjustable slide 42, and, on the other hand, each pulling element portion has one deflection roller 33, 34, supported freely rotatably externally to the slide 42 on the machine frame, so that each pulling element portion forms an open loop guided about the deflection roller 33, 34 between the control roller pair 37, 37'; 38, 38', respectively. As in the embodiment according to FIGS. 3 and 4, the tensioning device is in the form of tensioning plates 52, 53 that are adjustably connected to the slide 42 by means of the guide slots 59, and the control roller pairs 37, 37' and 38, 38' are supported on the plates 52, 53.

While specific embodiments of the invention have been shown and described in detail to illustrate the inventive principles, it will be understood that the invention may be embodied otherwise without departing from such principles.

What is claimed is:

1. An arrangement for applying an adhesive to outer surfaces of an inner book to be inset into a book cover by means of an insetting machine, moving inner books on saddle plates of a circulating conveyor vertically upwardly, the arrangement comprising:

an adhesive applying device comprising two application rollers positioned opposite one another in an area of adhesive application;

the two application rollers configured to each roll along one of the outer surfaces of the inner book to apply an adhesive onto the outer surfaces of the inner book as the inner book is moved upwardly on a saddle plate;

the two application rollers each having a recess forming a shoulder parallel to an axis of rotation of the application rollers, wherein the recesses are configured to apply the adhesive to grooves of the inner book and wherein a rotary position of the recesses is adjustable according to a position of a given groove shape of the inner book passing through the area of adhesive application;

the two application rollers and the conveyor of the saddle plates configured to be coupled by a drive connection so as to be driven in a cycle-synchronized way;

the drive connection comprising a pulling element gear unit configured to allow continuous adjustment of a relative position between the saddle plates and the rotary position of the application rollers.

2. The arrangement according to claim 1, wherein the pulling element gear unit comprises a circulating pulling element connected drivingly to the conveyor and to the application rollers.

3. The arrangement according to claim 2, wherein the pulling element gear unit comprises a slide moveably mounted on a guide arrangement, a first pair of stationary, spaced apart first deflecting rollers positioned externally to the slide and a first control roller mounted freely rotatingly on the slide and positioned between the first deflecting rollers, and a second pair of stationary, spaced apart second deflecting rollers positioned externally to the slide and a second control roller mounted freely rotatingly on the slide and positioned between the second deflecting rollers, wherein the pulling element has a first portion guided about the first deflecting rollers and the first control roller to form a first open loop and has a second portion guided about the second deflecting rollers and the second control roller to form a second open loop.

4. The arrangement according to claim 2, wherein the pulling element gear unit comprises a slide moveably mounted on a guide arrangement, a first pair of spaced apart control rollers mounted on the slide and a first stationary deflecting roller positioned between the first pair of spaced apart control rollers externally to the slide, and a second pair of spaced apart control rollers mounted on the slide and a second stationary deflecting roller positioned between the second pair of the spaced apart control rollers externally to the slide, wherein the pulling element has a first portion guided about the first deflecting roller and the first pair to form a first open loop and has a second portion guided about the second deflecting roller and the second pair to form a second open loop.

5. The arrangement according to claim 3, wherein the first and second open loops of the first and second portions of the pulling element are configured to be length-adjusted by moving the slide.

6. The arrangement according to claim 3, wherein the guide arrangement is configured to be connected to a frame of the insetting machine.

7. The arrangement according to claim 3, further comprising a controllable motor connected to the slide.

8. The arrangement according to claim 3, further comprising at least one tensioning plate moveably mounted on the slide, wherein the control rollers are supported on the at least one tensioning plate, and wherein the at least on tensioning plate is configured to be movable relative to the slide for adjusting a position of the slide or for tensioning the pulling element.

9. The arrangement according to claim 5, wherein the slide is configured to be moved on the guide arrangement in a plane perpendicular to the axes of the deflecting rollers.

10. The arrangement according to claim 7, further comprising a threaded bushing, connected to a side of the slide opposite the first and second control rollers, and a threaded spindle received in the threaded bushing and connected to the controllable motor.

11. The arrangement according to claim 4, wherein the first and second open loops of the first and second portions of the pulling element are configured to be length-adjusted by moving the slide.

12. The arrangement according to claim 4, wherein the guide arrangement is configured to be connected to a frame of the inset machine.

13. The arrangement according to claim 4, further comprising a controllable motor connected to the slide.

14. The arrangement according to claim 4, further comprising at least one tensioning plate moveably mounted on the slide, wherein the first and second pairs are supported on the at least one tensioning plate, and wherein the at least on tensioning plate is configured to be movable relative to the slide for adjusting a position of the slide or for tensioning the pulling element.

15. The arrangement according to claim 11, wherein the slide is configured to be moved on the guide arrangement in a plane perpendicular to the axes of the deflecting rollers.

16. The arrangement according to claim 13, further comprising a threaded bushing, connected to a side of the slide opposite the first and second pairs, and a threaded spindle received in the threaded bushing and connected to the controllable motor.

* * * * *